US005660298A

United States Patent [19]

Thompson

[11] Patent Number: 5,660,298

[45] Date of Patent: Aug. 26, 1997

[54] CONTAINER FOR READING MATERIAL WITH DUAL METHOD OF COUPLING WITH A BED

[76] Inventor: Gerald W. Thompson, S. Whitehorse Rd., Phoenixville, Pa. 19460

[21] Appl. No.: 751,575

[22] Filed: Nov. 18, 1996

[51] Int. Cl.[6] ..... B65D 85/672

[52] U.S. Cl. ..... 220/482

[58] Field of Search ..... 220/482, 478, 220/479, 480

[56] References Cited

U.S. PATENT DOCUMENTS 2,818,316 12/1957 Andrade ..... 220/482
4,143,431 3/1979 Concalves ..... 220/482
5,027,928 7/1991 Forbes et al. ..... 220/482
5,531,238 7/1996 Azzarelli et al. ..... 220/482

*Primary Examiner*—Joseph M. Moy

[57] ABSTRACT

The present invention includes a container with a rectilinear configuration for storage of reading material. Further provided is a mounting assembly including a first planar strip with a thin rectangular configuration. The first planar strip is integrally coupled along a first long edge coincidentally along a top edge of the rear face of the container. The mounting assembly also includes a second planar strip with a thin rectangular configuration hingably coupled to the first planar strip, whereby the mounting assembly may be situated on a bed rail of an associated bed or situated between two mattresses for affording a user in the bed convenient access to the reading material.

4 Claims, 3 Drawing Sheets

FIG 1
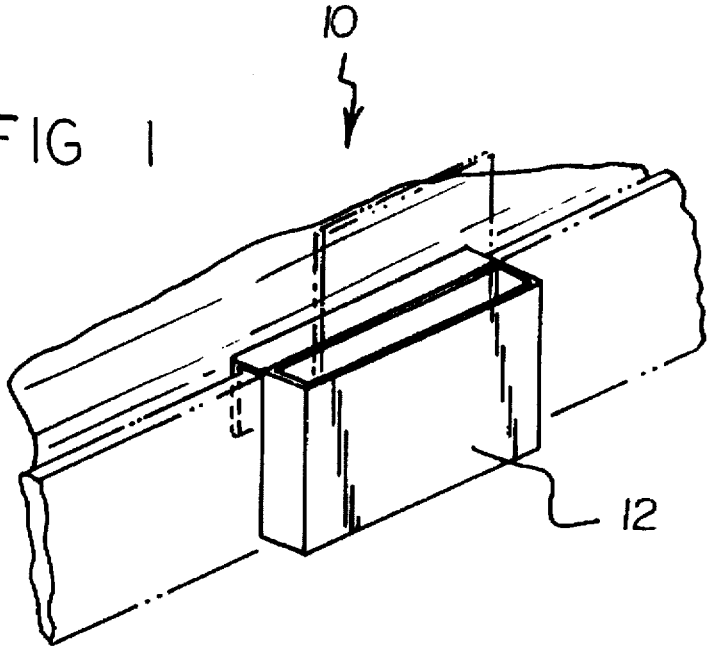
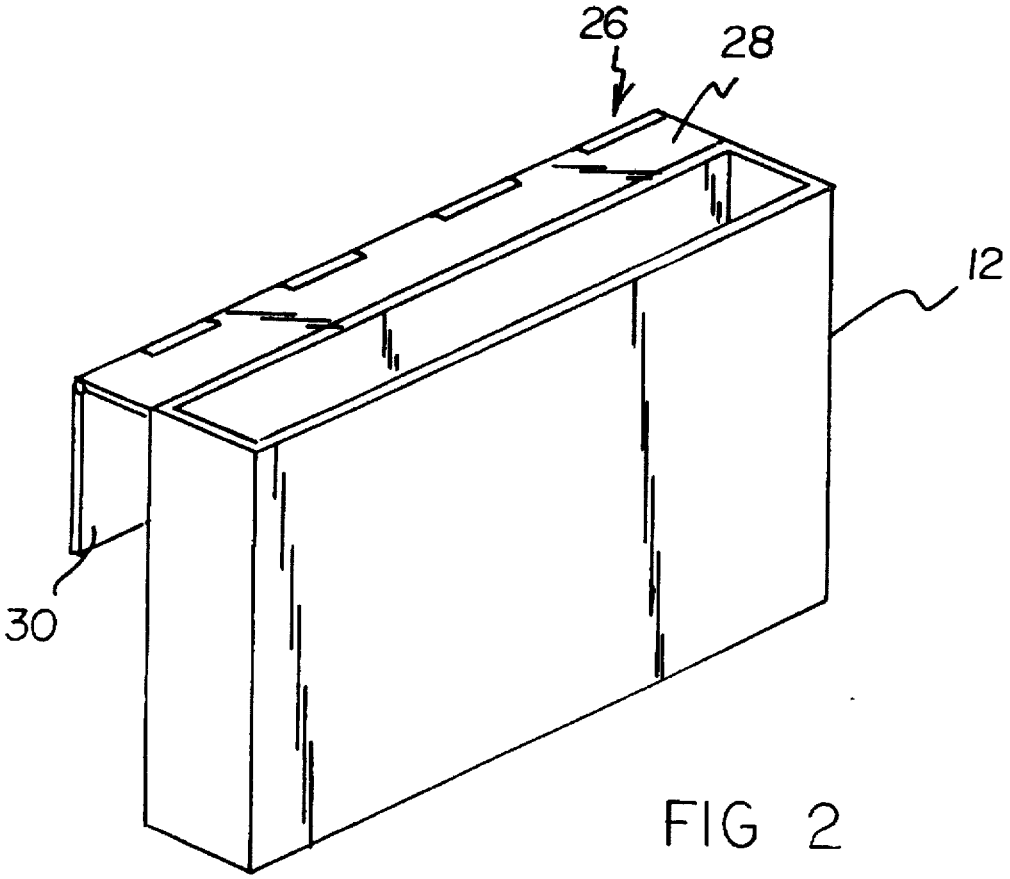
FIG 2

CONTAINER FOR READING MATERIAL WITH DUAL METHOD OF COUPLING WITH A BED

BACKGROUND OF THE INVENTION

1. Field of the Invention

The present invention relates to a container for reading material with dual method of coupling with a bed and more particularly pertains to allowing a container for reading material to be situated adjacent a bed by utilizing a mounting assembly which either engages a bed rail or is situated between a pair of mattresses thereof.

2. Description of the Prior Art

The use of containers for holding reading material is known in the prior art. More specifically, containers for holding reading material heretofore devised and utilized for the purpose of allowing convenient access to reading material are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 3,986,649 to Heimstra; U.S. Pat. Des. No. 257,993 to DeMars; U.S. Pat. No. Des. 268,687 to Rogers; U.S. Pat. No. Des. 359,404 to Svee; U.S. Pat. No. Des. 256,529 to Van Koert; and U.S. Pat. No. 4,901,883 to Hoffman.

In this respect, the container for reading material with dual method of coupling with a bed according to the present invention substantially departs from the conventional concepts and designs of the prior art, and in so doing provides an apparatus primarily developed for the purpose of allowing a container for reading material to be situated adjacent a bed by utilizing a mounting assembly which either engages a bed rail or is situated between a pair of mattresses thereof.

Therefore, it can be appreciated that there exists a continuing need for a new and improved container for reading material with dual method of coupling with a bed which can be used for allowing a container for reading material to be situated adjacent a bed by utilizing a mounting assembly which either engages a bed rail or is situated between a pair of mattresses thereof. In this regard, the present invention substantially fulfills this need.

SUMMARY OF THE INVENTION

In view of the foregoing disadvantages inherent in the known types of containers for holding reading material now present in the prior art, the present invention provides an improved container for reading material with dual method of coupling with a bed. As such, the general purpose of the present invention, which will be described subsequently in greater detail, is to provide a new and improved container for reading material with dual method of coupling with a bed which has all the advantages of the prior art and none of the disadvantages.

To attain this, the present invention essentially comprises a container with a rectilinear configuration. As shown in FIG. 1, the container has a front face, a rear face, a thin bottom face, a thin top opening, and a pair of thin side faces defining an interior space. The container is adapted to allow storage of reading material therein. Further provided is a mounting assembly having a first planar strip. The first planar strip has a thin rectangular configuration having a pair of long edges and a pair of short side edges coupled therebetween. The first planar strip is integrally coupled along a first long edge coincidentally to a top edge of the rear face of the container. As shown in FIG. 3, the first planar strip further resides in a horizontal orientation. Also included as a component of the mounting assembly is a second planar strip with a thin rectangular configuration. The second planar strip has a pair of long edges and a pair of short side edges coupled therebetween. The second planar strip is hingably coupled along one of the long edges thereof to a second long edge of the first planar strip. See FIG. 3. The mounting assembly further has a spring coupled between the first planar strip and the second planar strip. By this structure, the second planar strip has a first unbiased orientation with the second planar strip residing perpendicularly with respect to the first planar strip. The second planar strip further has a second biased orientation with the second planar strip residing within a plane in which the first plane resides.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved container for reading material with dual method of coupling with a bed which has all the advantages of the prior art containers for holding reading material and none of the disadvantages.

It is another object of the present invention to provide a new and improved container for reading material with dual method of coupling with a bed which may be easily and efficiently manufactured and marketed.

It is a further object of the present invention to provide a new and improved container for reading material with dual method of coupling with a bed which is of a durable and reliable construction.

An even further object of the present invention is to provide a new and improved container for reading material with dual method of coupling with a bed which is susceptible of a low cost of manufacture with regard to both materials and labor, and which accordingly is then susceptible of low prices of sale to the consuming public, thereby making such container for reading material with dual method of coupling with a bed economically available to the buying public.

Still yet another object of the present invention is to provide a new and improved container for reading material with dual method of coupling with a bed which provides in the apparatuses and methods of the prior art some of the advantages thereof, while simultaneously overcoming some of the disadvantages normally associated therewith.

Still another object of the present invention is to allow a container for reading material to be situated adjacent a bed by utilizing a mounting assembly which either engages a bed rail or is situated between a pair of mattresses thereof.

Lastly, it is an object of the present invention to provide a new and improved container with a rectilinear configuration for storage of reading material. Further provided is a mounting assembly including a first planar strip with a thin rectangular configuration. The first planar strip is integrally coupled along a first long edge coincidentally along a top edge of the rear face of the container. The mounting assembly also includes a second planar strip with a thin rectangular configuration hingably coupled to the first planar strip, whereby the mounting assembly may be situated on a bed rail of an associated bed or situated between two mattresses for affording a user in the bed convenient access to the reading material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the container for reading material with dual method of coupling with a bed constructed in accordance with the principles of the present invention.

FIG. 2 is a perspective view of the present invention.

Similar reference characters refer to similar parts throughout the several views of the drawings.

DESCRIPTION OF THE PREFERRED EMBODIMENT

Figure 3:
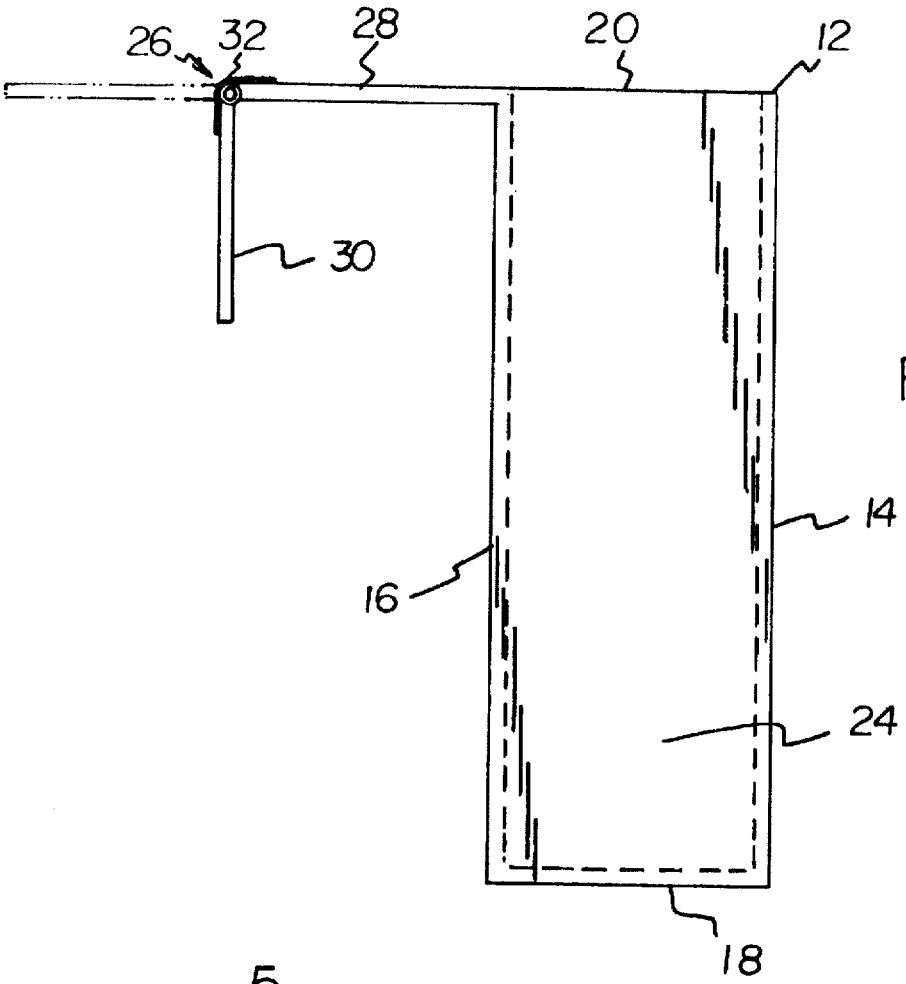
FIG. 3 is a side elevational view of the present invention.
Figure 4:
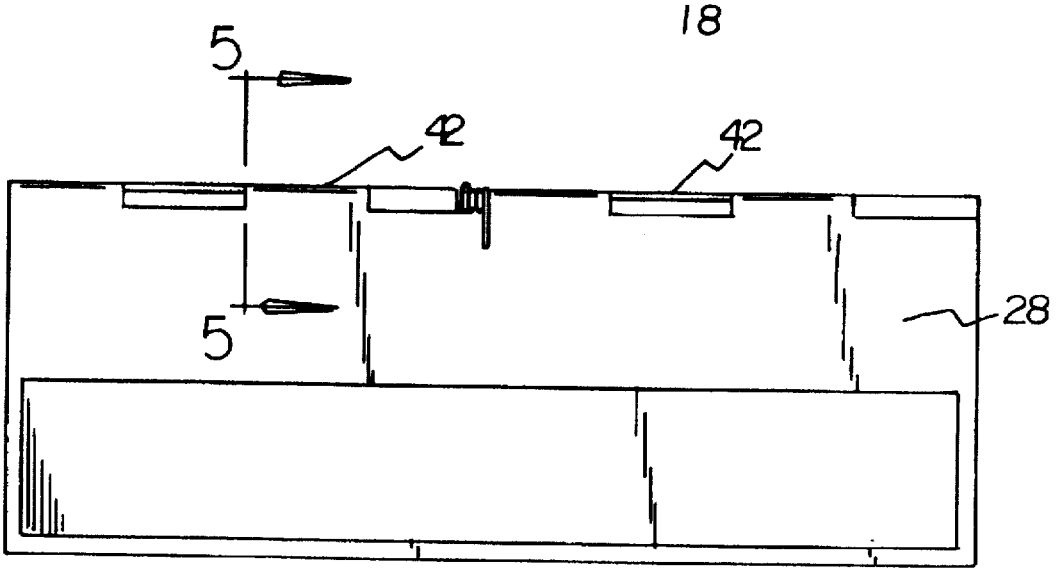
FIG. 4 is a top plan view of the present invention.

With reference now to the drawings, and in particular to FIG. 1 thereof, a new and improved container for reading material with dual method of coupling with a bed embodying the principles and concepts of the present invention and generally designated by the reference numeral 10 will be described.

The present invention, the new and improved container for reading material with dual method of coupling with a bed, is comprised of a plurality of components. Such components in their broadest context include a container and mounting assembly. Such components are individually configured and correlated with respect to each other so as to attain the desired objective.

More specifically, it will be noted that the system 10 of the present invention includes a container 12 with a rectilinear configuration. As shown in FIGS. 1–3, the container has a front face 14, a rear face 16, a thin bottom face 18, a thin top opening 20, and a pair of thin side faces 24 defining an interior space. Preferably, the surface area of the front and rear faces is greater than the that of the remaining faces. The container ideally has a height of approximately 12 inches, a length of approximately 14 inches, and a width of approximately 4 inches. Such dimensions afford a container which is sized to allow storage of reading material therein. The reading material may comprise of magazines, books and the like.

Further provided is a mounting assembly 26 having a first planar strip 28. The first planar strip has a thin rectangular configuration having a pair of long edges and a pair of short side edges coupled therebetween. The first planar strip is integrally coupled along a first long edge coincidentally to a top edge of the rear face of the container. As shown in FIG. 3, the first planar strip further resides in a horizontal orientation.

Also included as a component of the mounting assembly is a second planar strip 30 with a thin rectangular configuration. The second planar strip has a pair of long edges and a pair of short side edges coupled therebetween. The second planar is strip hingably coupled along one of the long edges thereof to a second long edge of the first planar strip. See FIG. 3.

The mounting assembly further has a spring 32 coupled between the first planar Strip and the second planar strip. By this structure, the second planar strip has a first unbiased orientation with the second planar strip residing perpendicularly with respect to the first planar strip. The second planar strip further has a second biased orientation with the second planar strip residing within a plane in which the first plane resides.

Figure 5:
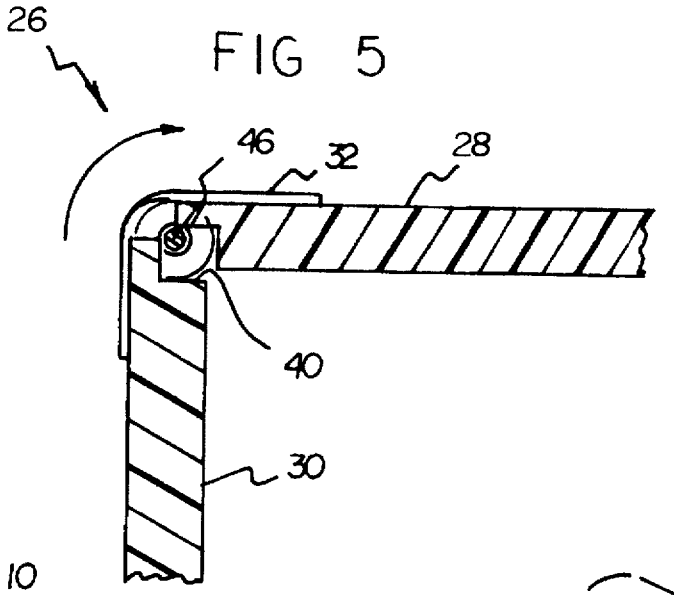
FIG. 5 is a cross-sectional view of the present invention taken along line 5—5 shown in FIG. 4.
Figure 6:
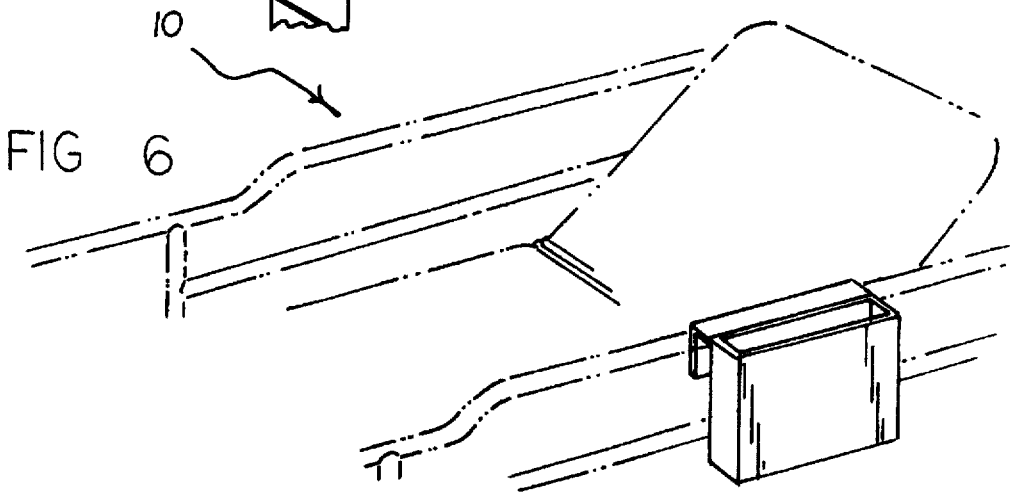
FIG. 6 is a perspective view of the present invention utilized on a bed rail of an associated bed.
Figure 7:
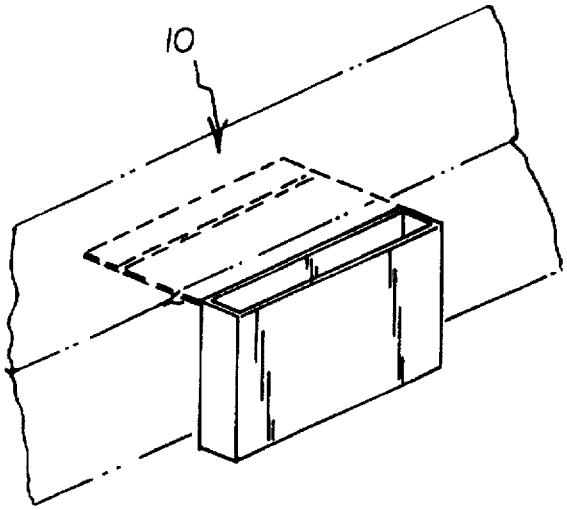
FIG. 7 is a perspective view of the present invention utilized between two mattresses of an associated bed.

As shown in FIG. 5, the movement of the second planar strip with respect to the first strip is constrained to 90 degrees of rotation. To accomplish this, rectilinear grooves 40 are formed in at least a small portion of the lower adjacent edges of the first and second planar strip. Actual coupling of the strips is afforded by a plurality of alternately situated closed loops 42 with a common bore through which a rod 46 is situated. The spring is ideally situated about the rod with a first prong abutting a surface of the first planar strip and a second prong abutting a surface of the second planar strip.

In use, upon the second planar strip of the mounting assembly being in the first orientation thereof, the mounting assembly may be situated on a bed rail of an associated bed. As such, the present invention is adapted for affording a user in the bed convenient access the reading material. Upon the second planar strip of the mounting assembly being in the second orientation thereof, both planar strips may be situated between a pair of mattresses of the bed for affording a user in the bed convenient access the reading material.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved container for reading material with dual method of coupling with a bed comprising, in combination:

a container with a rectilinear configuration having a front face, a rear face, a thin bottom face, a thin top opening, and a pair of thin side faces defining an interior space, the container adapted to allow storage of reading material therein; and a mounting assembly including a first planar strip with a thin rectangular configuration having a pair of long edges and a pair of short side edges coupled therebetween, the first planar strip integrally coupled along a first long edge coincidentally along a top edge of the rear face of the container, the first planar strip further residing in a horizontal orientation, the mounting assembly also including a second planar strip with a thin rectangular configuration having a pair of long edges and a pair of short side edges coupled therebetween, the second planar strip hingably coupled along one of the long edges thereof to a second long edge of the first planar strip, the mounting assembly further including a spring coupled between the first planar strip and the second planar strip, whereby the second planar strip has a first unbiased orientation with the second planar strip residing perpendicularly with respect to the first planar strip and a second biased orientation with the second planar strip residing within a plane in which the first plane resides;

whereby upon the second planar strip of the mounting assembly being in the first orientation thereof, the mounting assembly may be situated on a bed rail of an associated bed for affording a user in the bed convenient access the reading material and upon the second planar strip of the mounting assembly being in the second orientation thereof, both planar strips may be situated between a pair of mattresses of the bed for affording a user in the bed convenient access the reading material.

2. A container for reading material comprising:

a container with a rectilinear configuration having a front face, a rear face, a bottom face, a top opening, and a pair of side faces defining an interior space, the container adapted to allow storage of reading material therein; and a mounting assembly including a first planar strip with a thin rectangular configuration having a pair of long edges and a pair of short side edges coupled therebetween, the first planar strip integrally coupled along a first long edge coincidentally along a top edge of the rear face of the container, the first planar strip further residing in a horizontal orientation, whereby the first planar strip may be situated between a pair of mattresses of the bed for affording a user in the bed convenient access the reading material.

3. A container for reading material as set forth in claim 2 wherein the mounting assembly also includes a second planar strip with a thin rectangular configuration having a pair of long edges and a pair of short side edges coupled therebetween, the second planar strip hingably coupled along one of the long edges thereof to a second long edge of the first planar strip, the mounting assembly further including a spring coupled between the first planar strip and the second planar strip, whereby the second planar strip has a first unbiased orientation with the second planar strip residing perpendicularly with respect to the first planar strip and a second biased orientation with the second planar strip residing within a plane in which the first plane resides.

4. A container for reading material comprising:

a container with a rectilinear configuration having a front face, a rear face, a bottom face, a top opening, and a pair of side faces defining an interior space, the container adapted to allow storage of reading material therein; and a mounting assembly including a first planar strip with a thin rectangular configuration having a pair of long edges and a pair of short side edges coupled therebetween, the first planar strip integrally coupled along a first long edge coincidentally along a top edge of the rear face of the container, the first planar strip further residing in a horizontal orientation, the mounting assembly also including a second planar strip with a thin rectangular configuration having a pair of long edges and a pair of short side edges coupled therebetween, the second planar strip perpendicularly coupled along one of the long edges thereof to a second long edge of the first planar strip, whereby the mounting assembly may be situated on a bed rail of an associated bed for affording a user in the bed convenient access the reading material.

* * * * *